United States Patent [19]

Cheek

[11] 4,105,082

[45] Aug. 8, 1978

[54] JARRING TOOL

[76] Inventor: Alton E. Cheek, 1949 Vuelta Grande Ave., Long Beach, Calif. 90815

[21] Appl. No.: 741,713

[22] Filed: Nov. 15, 1976

Related U.S. Application Data

[63] Continuation of Ser. No. 638,437, Dec. 8, 1975, abandoned.

[51] Int. Cl.[2] ..... E21B 1/10

[52] U.S. Cl. ..... 175/302

[58] Field of Search ..... 175/299, 300, 302, 303

[56] References Cited

U.S. PATENT DOCUMENTS

| | | | |
|---|---|---|---|
| 2,008,765 | 7/1935 | McCullough | 175/303 |
| 2,029,579 | 2/1936 | McCullough | 175/303 |
| 2,101,968 | 12/1937 | Wickersham | 175/302 |
| 2,144,810 | 1/1939 | Raymond | 175/303 |
| 2,562,321 | 7/1951 | Lowe | 175/302 |
| 3,685,598 | 8/1972 | Nutter | 175/304 |
| 3,735,827 | 5/1973 | Berryman | 175/303 |
| 3,797,591 | 3/1974 | Berryman | 175/296 |

*Primary Examiner*—James A. Leppink
*Attorney, Agent, or Firm*—Albert L. Gabriel

[57] ABSTRACT

A jarring tool for use in a drill string to prevent sticking of the drill string during drilling operations. The jarring tool has a torque assembly for continually torquing the jar and thus the drilling operation need not be discontinued upon encountering an interfering object. The jarring tool is particularly suited for high viscosity drilling operations and eliminates hydrostatic sticking of the drill string by providing an immediate jarring action utilizing a simple hammer and anvil construction. The jarring tool is also suitable for use in a "fishing" string.

15 Claims, 7 Drawing Figures

2
6
1
2
4
7
2

6
10
8
19
4
19
4
16
16
18
18
2
20
14
12
5
22
3
86
84
5
26
32
30
88
4
78
76
74
A
36
70
34
35
B
50
51
24
38
60
62
68
90
82
80
3
7

FIG. 3
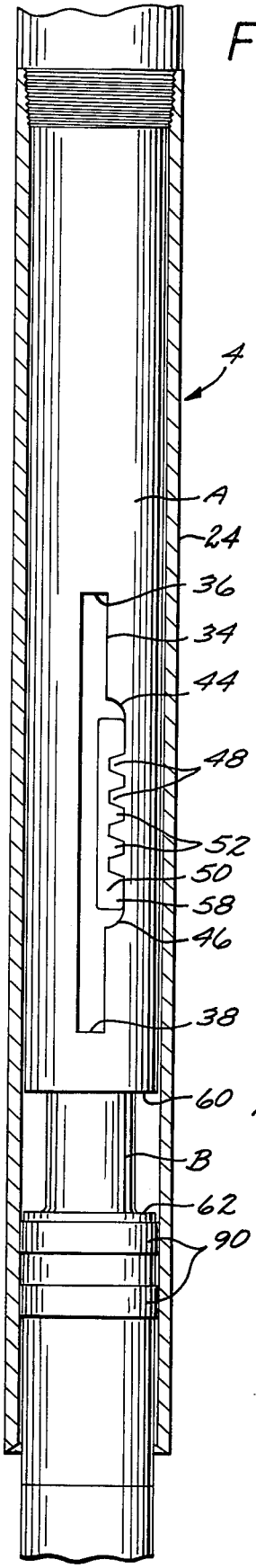
FIG. 4
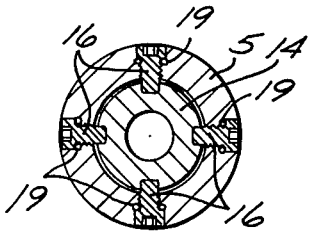
FIG. 6
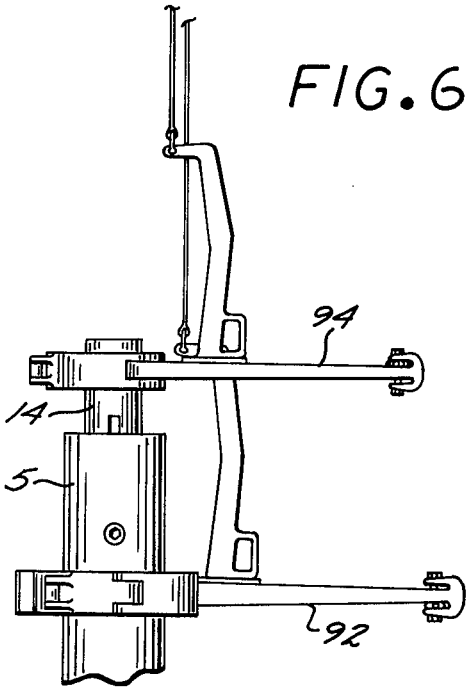
FIG. 5
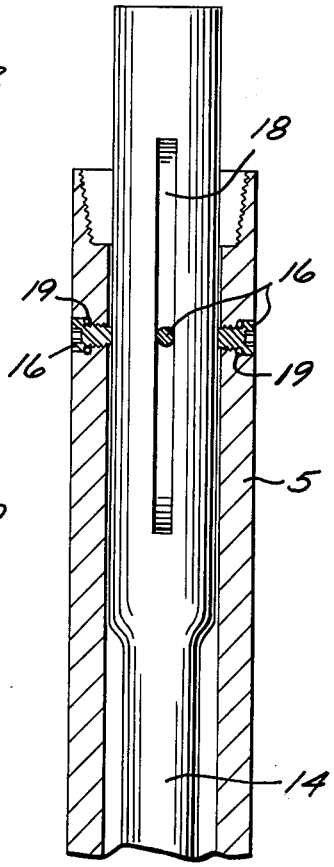
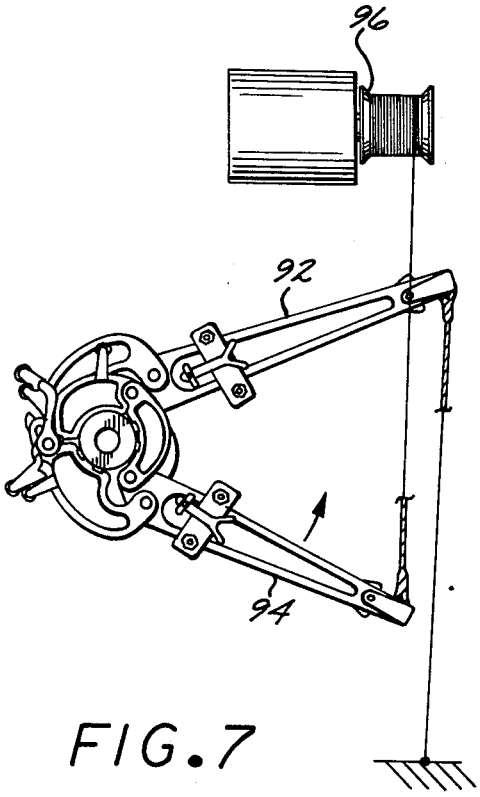
FIG. 7

JARRING TOOL

This is a continuation of application Ser. No. 638,437, filed Dec. 8, 1975, now abandoned.

BACKGROUND OF THE INVENTION

1. Field of the Invention

The invention pertains to a pre-torqued jarring tool utilized to prevent sticking of a drill string in a drilling operation or to remove a stuck pipe or "fish" downstream of the jarring tool.

2. Description of the Prior Art

Many jarring tools have been devised for releasing a stuck drill string or for use in retrieving "fish" such as drill pipe or tools which are stuck in a well bore. Such jarring devices are designed to produce an upward or downward jarring action to the stuck drill bit or to the fish or lost part in order to release the stuck element and continue drilling operations. These jarring tools generally utilize a hammer and anvil arrangement of telescoping sections to impart the jarring force. Jarring tools may range from a simple construction such as that shown in McCullough U.S. Pat. No. 2,029,579 to sophisticated hydraulic mechanisms such as those taught by Berryman U.S. Pat. Nos. 3,735,827 and 3,797,591. Prior art jarring tools have been developed with adjustable triggering mechanisms so that the jarring action takes place at different compressional or tensile forces placed on the drill or fishing string. Illustrations of such adjustable triggering mechanisms are shown, for example, in the McCullough U.S. Pat. No. 2,008,765, Raymond U.S. Pat. No 2,144,810 and Nutter U.S. Pat. No. 3,685,598. In these prior art devices, it is possible to adjust the triggering mechanism and consequently the force of the jarring action while the jarring tool is positioned within the well bore. The adjustable triggering mechanisms associated with prior art jarring tools comprise various adjustable spring mechanisms and clutches or, in some cases, hydraulic valve systems. These prior art devices are complex, prone to mechanical failure and are expensive to manufacture and operate.

Perhaps the simplest jarring tool devised is the McCullough tool as shown and described in U.S. Pat. No. 2,029,579. The jarring tool described therein is particularly advantageous due to its simplicity of construction and reliability of operation. A prime disadvantage, however, in utilizing such a tool is the inability to pretorque the tool and to vary the amount of torque as a function of the medium being drilled. Thus, while it is advantageous to utilize the simple mechanism as taught by McCullough, the practical difficulties encountered in stopping the drilling process to apply torque to the drill string prevents the economical and efficient operation of the McCullough device in many drilling operations. For example, the McCullough tool is particularly prone to hydrostatic sticking, which may occur along the entire drill string, if the drilling process is at all interrupted before the jarring action takes place. Thus, the necessity for torquing the drill string at the surface upon any momentary stoppage of the drilling process renders this simple McCullough jarring tool ineffective particularly in high viscosity mediums which are present, for example, in the highly productive Mideast oil fields.

SUMMARY OF THE INVENTION

It is therefore an object of the invention to eliminate the disadvantages of the prior art jarring tools by providing an immediate jarring action utilizing a pre-torqued jarring instrument.

A further object of the invention is to provide an adjustable pre-torqued jarring instrument which may be preloaded in the field in order to achieve greater or lesser jarring forces dependent upon the medium viscosity in the well bore.

A further object of the invention is to provide a simple torque assembly for preloading the jarring tool of the type described in McCullough U.S. Pat. No. 2,029,579.

A further object of the invention is to provide a jarring tool which may be inserted anywhere in a drill or fishing string.

Yet another object of the invention is to provide a simple hammer and anvil jarring tool which does not utilize complicated coiled springs or hydraulic mechanisms to achieve an adjustable preloading of the jarring mechanism.

Yet another object of the invention is to provide a jarring tool which eliminates hydrostatic sticking by providing an immediate jarring action upon compressional or tensile forces exceeding adjustable threshold limits.

A further object of the invention is to provide an adjustable threshold triggering mechanism for compressional and tensile forces along the drill string.

The invention comprises hammer and anvil sections which are movable in telescoping fashion relative to one another and are provided with a pre-torquing means which itself may be adjusted to provide various triggering levels. The telescoping sections are latched together by means of teeth having inclined engaged surfaces which disengage upon the application of a predetermined tensile or compressional force. Disengagement of the teeth renders the hammer section movable longitudinally with respect to the anvil section and thereby supplies the jarring action to the drill or fishing string. The teeth of the respective hammer and anvil sections are biased together utilizing the torquing means so as to maintain a continual force between the teeth thereby continually preloading the jarring tool for instantaneous action if the compressional or tensile forces exceed the threshold limits. The threshold limits are adjustable by applying different amounts of torque to a torque tube connected to one member of the hammer and anvil pair. The torque is adjustable in the field and does not require dismantling of the jarring tool.

BRIEF DESCRIPTION OF THE DRAWINGS

These and other objects of the invention will become more apparent in view of the following description taken in conjunction with the drawings wherein:

FIG. 3 is a side elevational view of the jar means of the instant invention with the outer housing portion shown in section taken along line 3—3 of FIG. 2;

FIG. 4 is a cross-sectional view of a portion of the jarring tool taken along line 4—4 of FIG. 2;

FIG. 5 is a side elevational view of a portion of the torque assembly of the instant invention with the pipe housing shown in cross section;

FIG. 6 shows a side view of the jarring tool with the preloading tongs in position; and FIG. 7 is a top view of the preloading tongs as shown in FIG. 6.

DETAILED DESCRIPTION OF THE PREFERRED EMBODIMENT

Figure 1:
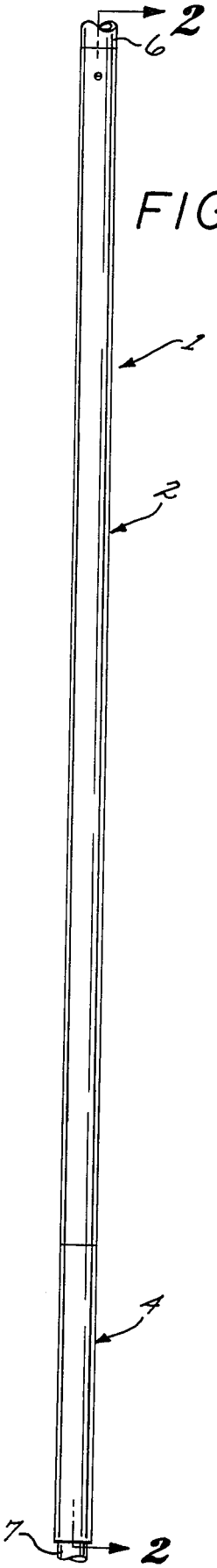
FIG. 1 is an elevational view of the jarring tool as positioned in a drill string.

As illustrated in FIG. 1, the jarring tool 1 of the instant invention comprises a torque assembly 2 and a jar means 4 connected together in a drill string. The jarring tool may be positioned anywhere within the drill string and as illustrated in FIG. 1, one generally would have additional pipe sections 6 and 7 positioned respectively above and below the jarring tool. In some instances, the pipe section 7 may be a "fish" such as a drill pipe or subsurface tool stuck in the well bore. Additionally, the pipe section 6 may be a top sub (rotary drilling substitute).

Figure 2:
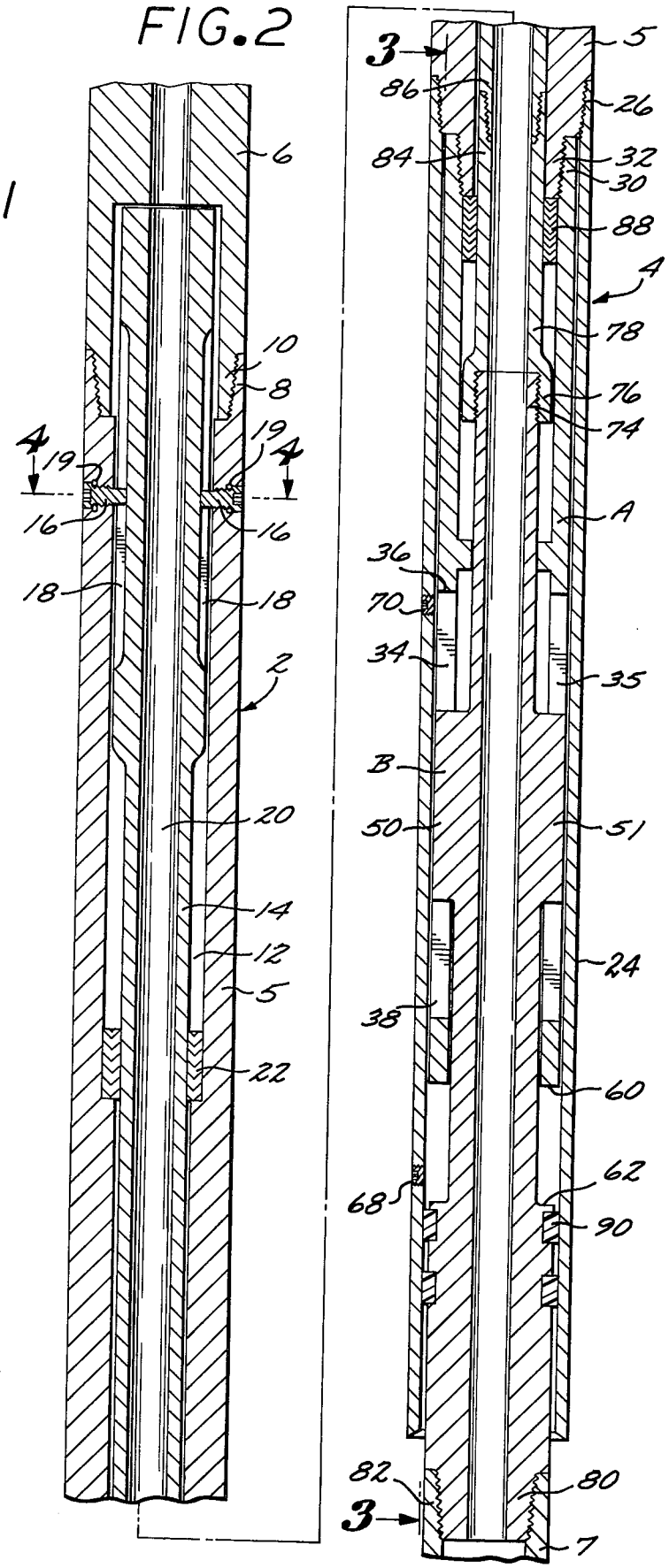
FIG. 2 is an enlarged detail sectional view of the jarring tool illustrating the torquing tube and hammer and anvil sections.

As illustrated in FIG. 2, the torque assembly 2 comprises a pipe housing 5 which has at its upper end a threaded portion 8 connected to a mating threaded portion 10 of the pipe section 6. The pipe housing 5 has a passageway 12 in which is positioned an elongated torque means in the form of a torque tube 14. The torque tube 14 is torsionally secured to the pipe housing 5 proximate the upper end of housing 5 by clamping means which may comprise a plurality of lugs or cap screws 16 which are threaded into the pipe housing 5 and extend radially into longitudinal recesses or slots 18 milled in the torque tube 14. O-ring seals 19 are provided adjacent the cap screws 16 to prevent leakage of circulation fluids. The torque tube 14 has a central longitudinal fluid passageway 20 which serves as a wash pipe, and torque tube 14 is further positioned centrally of the passageway 12 within the pipe housing 5 by means of a floating bushing or packing 22.

As illustrated in the right-hand portion of FIG. 2 with additional reference to FIG. 3, the jar means 4 comprises an outer housing 24 and two telescoping sections A and B. Tubular section A serves as a hammer and stem section B serves as an anvil. It is noted, however, that the jarring tool may be operated in an inverted position from that shown in FIG. 2, and in such cases, the "hammer" function is served by section B whereas the section A becomes the anvil. For ease of description, sections A and B are termed hammer and anvil respectively although this terminology is not meant to be limiting.

The upper end of hammer section A contains a threaded portion 30 which is coupled with a mating threaded portion 32 in the lower section of housing 5. Section A contains a slot 34 and an identical but diametrically oppositely disposed slot 35 therethrough. As best illustrated in FIG. 3, slot 34 has an upper end 36 and a lower end 38. Further, slot 34 has a side extension having an upper rounded portion 44 and a lower rounded portion 46 with a plurality of teeth means 48 therebetween. Slots 34 and 35 are designed to contain respective identical, diametrically opposed projecting portions or lugs 50 and 51 which themselves are integrally connected to the anvil section B of the jar means 4; however, to simplify the present description, the details of construction will be set forth primarily with references to the slot 34 and lug 50. Lug 50 has mating teeth means 52 which fit in between the gaps defined by teeth means 48 of section A. Further, lug 50 has an upper end portion 56 and a lower end portion 58 which portions are designed to abut the upper end 36 and lower end 38 respectively of section A during upward and downward jarring action. A lower end 60 of section A also comes in contact with a portion 62 of section B during a downward jarring stroke. The upper and lower ends 36 and 38 respectively of the hammer section A thus define the limit of travel of the hammer section A relative to anvil section B. A portion of anvil section B extends into the tubular section A, and during an upward jarring stroke a lesser portion of section B extends into section A whereas during a downward jarring stroke a greater portion of section B extends into section A.

The housing 24 is filled with a lubricating fluid such as oil, and an oil plug 68 is provided in housing 24 for introducing such lubricating fluid. Also provided in outer housing 24 is an air vent 70 utilized to vent air upon filling the housing 24 with lubricating fluid.

The anvil section B of the jar means 4 has an upper threaded portion 74 which connects with a lower mating threaded portion 76 of a coupling tube 78. Coupling tube 78 is an extension of torque tube 14. Anvil section B has a lower threaded portion 80 which connects with a mating threaded portion 82 in the downstream pipe section 7. The coupling tube 78 is connected to the torque tube 14 by means of a threaded portion 84 on coupling tube 78 and mating threaded portion 86 on torque tube 14. Floating bushings 88 similar to bushing 22 are provided between an inner wall of the hammer section A and the outer wall of the coupling tube 78. A plurality of oil seals 90 are provided on the lower portion of the anvil section B to seal oil within the housing 24.

FIG. 4 is a cross-sectional view of the torque assembly 2 taken along line 4—4 of FIG. 2. The cap screws 16 are shown threaded into pipe housing 5 and extending into the recesses or slots 18 in the outer wall of torque tube 14.

A side partial elevational view of the torque assembly 2 is shown in FIG. 5 with the outer housing shown in cross section and with pipe section 6 removed. The cap screws 16 are threaded into the housing 5 until a section thereof extends into the slots 18. Slots 18 have a longitudinal extent somewhat greater than the extent of the downstroke and upstroke of the hammer A relative to the anvil B as defined by the longitudinal extent of movement of lugs 50 and 51 in their respective slots 34 and 35. Thus, the cap screws 16 serve to prevent relative rotation of the torque tube 14 with respect to the pipe housing 5 but nevertheless permit longitudinal motion which takes place during an upward or downward jarring stroke.

FIGS. 6 and 7 illustrate the method of preloading or pre-torquing the torque tube utilizing wrenches or tongs. The pipe section 6 is removed and a first tong 92 is anchored against rotation and is secured to the outer housing 5 of the torque assembly 2. A second tong 94 is clamped to the top portion of the torque tube 14 and is rotated via motor means 96 in a counterclockwise direction as shown in FIG. 7. Prior to each increment of rotation, the cap screws 16 are loosened sufficiently so that no portion thereof extends into the slots 18 and the torque tube is therefore not in contact with cap screws 16. A torsional stress is put on torque tube 14 by rotating it in a counterclockwise direction relative to the housing 5. The torque tube 14 may be rotated any multiple of 90° relative to the housing 5 when the torque assembly 2 is provided with four cap screws 16 and corresponding slots 18. However, additional slots may be provided in the torque tube 14 and/or additional cap screws may be utilized so that a finer adjustability of torsional stress may be achieved. Rotation of the torque tube 14 by means of the tongs 92 and 94 biases the teeth means 52 of anvil section B against the teeth means 48 of hammer section A. The amount of rotation of torque tube 14 relative to housing 5 determines the amount of compressional force exerted between the teeth means 52 and 48 and consequently sets the threshold for compressional and tensile forces along the pipe which are required to trigger the jarring operation.

OPERATION

In operation, the amount of preloading is set in the field utilizing the pre-torquing apparatus as shown in FIGS. 6 and 7. Typically, one might utilize a 90° rotation of the torque tube 14 relative to the housing 5 which may typically set a 45 ton compressional trigger level. However, the amount of rotation will vary depending upon the diameter of the torque tube 14 and housing 5 as well as the particular viscosity of the medium being drilled. Rotation of the torque tube 14 in a counterclockwise direction relative to the housing 5 serves to bias the teeth means 52 of anvil section B against the teeth means of hammer section A in the jar means 4. In a downward jarring situation, the anvil section B becomes temporarily stuck in the medium being drilled and compressional forces are built up along the drill string and are transmitted between sections A and B via teeth means 48 and 52. Teeth means 48 and 52 have inclined edges and are pitched such that the teeth will snap out of engagement after a predetermined threshold longitudinal compressional stress is applied. The amount of compressional stress would of course be a function of the amount of torsional stress established by the preloading rotation of the torque tube 14 in the housing 5. Just prior to release of the teeth means 48 and 52, the hammer section A is forced to rotate a small amount in a right-hand or clockwise direction relative to the anvil section B by the camming action of the engaged inclined surfaces of the teeth means 48 and 52. Upon disengagement of the teeth means, however, the compressional forces exerted on the hammer section A cause it to move forcibly downward until the upper end 36 of slot 34 strikes the upper end portion 56 of lug 50. Additionally, the lower hammer end 60 will strike the lower portion 62 of the anvil section B. The jarring action of the hammer section A against the anvil section B tends to loosen the anvil and free it for subsequent drilling. In order to reset or relatch the jar means 4, the drill string is pulled upward releasing the compressional forces and causing the hammer section A to slide upward relative to the anvil section B until the teeth 48 and 52 are again meshed together as shown in FIG. 3.

In the upward jarring action, the tensile forces between the hammer section A and the anvil section B are again transmitted through teeth means 48 and 52. Once the threshold tensile force is reached, the hammer section A will again be cammed by the teeth means 48 and 52 to rotate a small amount in a right-hand sense thereby disengaging teeth means 48 from the teeth means 52 and allowing the hammer section A to travel upward relative to the anvil section B. Hammer A will travel upward until the lower end 38 of slot 34 hits lower end portion 58 of lug 50. The jarring action thus provided will tend to lift the anvil section B upward thereby tending to loosen it. In order to relatch the jar means 4, the drill string is released thereby placing compressional forces on the hammer section A and causing it to move downwardly relative to anvil section B until teeth means 48 and 52 are again meshed as shown in FIG. 3.

The jarring tool may thus be utilized to provide repeated upward and/or downward jarring actions to the anvil section B and thus to subsequent pipe sections 7 as well as additional downstream pipe sections. The utilization of the torque tube 14 to maintain a preloading of the jar means 4 enables an immediate triggering of the jar means inasmuch as the jar means does not have to be torqued from the surface as in conventional jarring tools. Additionally, the utilization of the torque tube 14 eliminates any slippage between the teeth means of sections A and B respectively thereby permitting the jarring tool to be positioned deep in a drill string without excessive frictional wear between the teeth means which has been a common problem in conventional jarring tools.

The preloading of the jar means 4 by the torque tube 14 is particularly advantageous in preventing hydrostatic sticking along the length of the pipe string as is prevalent in high viscosity drilling mediums. The jarring means 4 is particularly versatile in that it may be positioned as shown in FIG. 2 or it may be positioned in an inverted position so that section A becomes the anvil whereas section B becomes the hammer. The preloaded aspects of the invention are not affected by such inversion.

It is also noted that the particular clamping means such as the cap screws 16 and slots 18 utilized to provide torsional stress along the torque tube 14 may be replaced by other mechanical devices such as a splined connection to achieve the same results.

The jar means incorporated in the torque tube assembly 2 is particularly simple to manufacture and operate and is not prone to numerous mechanical failures which are prevalent in more complicated jarring tools. The jarring tool may not only be adjustably preloaded in the field, but may be positioned anywhere in the drill string, and operates simply and effectively without complex threaded connections, coiled springs, or hydraulic valves.

Although the invention has been described with reference to a preferred embodiment, other modifications and improvements may be made by those of skill in the art and it is intended that the invention cover all such modifications and improvements as defined by the appended claims.

I claim:

1. An elongated jarring tool adapted for producing jarring impacts in both longitudinal directions comprising:

a tubular section, a stem section positioned for relative longitudinal movement with respect to said tubular section between first and second jarring positions, a first pair of opposed shoulder means on the respective said sections engageable to define said first jarring position and a second pair of opposed shoulder means on the respective said sections engageable to define said second jarring position, said tubular section having a longitudinal slot in a wall thereof, and said stem section having a lug member thereon projecting within said slot, said lug member being shorter than said slot in the longitudinal direction to enable relative longitudinal movement of said sections between said jarring positions, first teeth means on said tubular section adjacent said slot and second teeth means on said lug member, said first and second teeth means being meshable with each other and being tapered so that longitudinal force in either direction between said section will tend to cam said first and second teeth means rotationally apart toward disengagement to initiate a jarring action, locating means on said sections longitudinally locating said sections relative to each other at a position intermediate said jarring positions when said first and second teeth means are in their meshed position, and an elongated torque means connected at one end to said stem section for rotationally biasing said first and second teeth means toward their meshed position, and clamping means for connecting the other end of said torque means in a fixed rotational position relative to said tubular section.

2. A jarring tool as recited in claim 1, wherein said clamping means is adjustable for clamping said other end of said torque means at a plurality of different rotational positions relative to said tubular section.

3. A jarring tool as recited in claim 1, wherein said clamping means comprises screw means, and said other end of said torque means has a plurality of longitudinally disposed recesses therein and said screw means is adapted to be extended at least partially into at least one of said recesses.

4. A jarring tool as recited in claim 1, wherein said torque means is connected to said stem section by threaded coupling means.

5. A jarring tool as recited in claim 1, wherein said single torque means comprises a torque tube.

6. A jarring tool as recited in claim 5, wherein said torque tube has a central longitudinal fluid passageway therethrough, and said tubular section and said stem section have central longitudinal passageways therethrough in alignment with and in communication with said passageway of said torque tube.

7. A jarring tool as recited in claim 1 further comprising a cylindrical housing surrounding said tubular section and said portion of said stem section and spaced therefrom.

8. A jarring tool as recited in claim 7 further comprising a fluid seal between said stem section and said cylindrical housing.

9. A jarring tool as recited in claim 8, wherein said space between said tubular section and said cylindrical housing contains a lubricating fluid.

10. A jarring tool as recited in claim 9, wherein said lubricating fluid is oil.

11. A jarring tool as recited in claim 10 further comprising an oil plug in said cylindrical housing.

12. A jarring tool as recited in claim 11 further comprising an air vent in said cylindrical housing.

13. A jarring tool as recited in claim 1, wherein said teeth means of said tubular section are formed by notches in the wall of said tubular section adjacent said slot.

14. A jarring tool as recited in claim 13, wherein said tubular section has a plurality of said slots and respective teeth means disposed in peripherally spaced relationship, and said stem section has a plurality of said lug members and respective teeth means disposed in peripherally spaced relationship and engaged in the respective said slots.

15. A jarring tool as recited in claim 1, wherein said tubular section is substantially rigid against torsional bending.

* * * * *